US007015406B2

(12) United States Patent
Ganz et al.

(10) Patent No.: US 7,015,406 B2
(45) Date of Patent: Mar. 21, 2006

(54) ELECTRIC CONTACT

(75) Inventors: Joachim Ganz, Kapfenhardt (DE); Franz Kaspar, Niefern-Öschelbronn (DE); Isabell Buresch, Illertissen (DE)

(73) Assignees: Ami Doduco GmbH, Pforzheim (DE); Wieland Werke AG, Ulm (DE)

( * ) Notice: Subject to any disclaimer, the term of this patent is extended or adjusted under 35 U.S.C. 154(b) by 9 days.

(21) Appl. No.: 10/486,000

(22) PCT Filed: Aug. 2, 2002

(86) PCT No.: PCT/EP02/08603

§ 371 (c)(1),
(2), (4) Date: Feb. 3, 2004

(87) PCT Pub. No.: WO03/015217

PCT Pub. Date: Feb. 20, 2003

(65) Prior Publication Data

US 2004/0238338 A1 Dec. 2, 2004

(30) Foreign Application Priority Data

Aug. 3, 2001 (DE) ..... 101 38 204

(51) Int. Cl.
*H01H 1/02* (2006.01)

(52) U.S. Cl. ..... 200/269; 200/262; 200/266

(58) Field of Classification Search ..... 200/262–269
See application file for complete search history.

(56) References Cited

U.S. PATENT DOCUMENTS

| | | | | | |
|---|---|---|---|---|---|
| 2,812,406 | A | * | 11/1957 | Egan | 200/266 |
| 4,339,644 | A | * | 7/1982 | Aldinger et al. | 200/266 |
| 5,139,890 | A | * | 8/1992 | Cowie et al. | 428/670 |
| 5,860,513 | A | * | 1/1999 | Suzuki | 200/268 |

FOREIGN PATENT DOCUMENTS

| | | |
|---|---|---|
| DE | 3715171 | 11/1987 |
| DE | 4013627 | 10/1991 |
| DE | 4327924 | 3/1994 |
| DE | 19617138 | 8/1996 |
| GB | 2130795 | 6/1984 |

* cited by examiner

*Primary Examiner*—Michael A. Friedhofer
(74) *Attorney, Agent, or Firm*—Orum & Roth LLC

(57) ABSTRACT

An electric contact comprises a main body consisting of a copper-based alloy or of stainless steel and a contact layer consisting of a gold-based alloy. The contact layer has a thickness of at least 0.3 $\mu$m and consists of gold with a content of 0.5 percent by weight to 15 percent by weight of one or more platinum group metals, and that an intermediate layer consisting of silver or of a silver-based alloy or of nickel is provided between the main body and the contact layer. The contact layer is preferably applied on the main body by a PVD process.

19 Claims, 1 Drawing Sheet

ELECTRIC CONTACT

BACKGROUND OF THE INVENTION

1. Field of the Invention

The present invention relates to an electric contact More specifically, the invention relates to electric contacts used as plug-in contacts, for example in plug-in connectors, in automobiles and telecommunications applications.

2. Description of Related Art

Today, it is a requirement that plug-in connectors used in the automotive industry be suited for ambient temperatures of up to 150° Celsius and that their spring properties should not decrease over the usual service life of automobiles to an extent that would impair their contact-making reliability. Known electrical contacts for such applications consist of a main body, made from a copper-based alloy that provided the required electric conductivity and spring properties, and from a hard gold layer that, which is applied onto the main body by galvanic deposition and which consists of gold with a cobalt content of less that 1 percent by weight. Further it has been known to provide on the main body, as a contact layer, a silver layer instead of a hard gold layer. Frequently, one also uses contact layers consisting of tin, which are applied upon the main body by tinning. Given the marginal conditions required hereto for, it has been possible in this way to achieve a sufficient degree of wear resistance of the electric contacts and a sufficiently low contact resistance. This is, however, no longer true for plug-in contacts, which are required, for example according to US Car Specifications, to meet increased temperature demands of up to 200° Celsius under changing temperature conditions over the envisaged service life. These stricter demands result from the fact that an ever increasing number of engine functions are to be monitored and controlled electrically or electronically, for which purpose the use of the electronic system and, thus, of plug-in contacts, is required at the very location on the engine or in the exhaust system.

The gold-cobalt contact layers used heretofore are not suited for such increased temperature demands because cobalt will segregate from the alloy at temperatures above 150° Celsius with the result that the cobalt will then be able to oxidise which in turn will increase the contact resistance. Tinned contacts cannot be used at temperatures of 200° Celsius, either, because that temperature is near the melting point of tin, namely 232° Celsius, and the tin will start to soften and to creep. The accelerated diffusion of Sn in Cu, and vice versa, very rapidly leads to the formation of intermetallic phases which oxidise and lead to high contact resistance. In the case of Ag coatings, irreversible softening occurs at temperatures of approximately 160° Celsius and over.

In telecommunication applications very high insertion cycles—frequently of up to 10,000—are required. Today, these demands are met by plug-in contacts comprising a PdNi or PdCo coating as contact layer. However, the strongly risen Pd price has made such coatings very expensive.

SUMMARY OF THE INVENTION

Now, it is the object of the present invention to make available a low-cost contact structure, which is especially well suited to meet the increased demands (ambient temperatures of 200° Celsius and voltage of 42 V) and which is especially suited for plug-in contacts in automobiles and telecommunication applications.

This object is achieved by a plug-in contact having the features defined in claim 1. Advantageous further developments of the invention are the subject-matter of the subclaims.

An electric contact comprising a main body consisting of a copper-based alloy or of a stainless steel and a contact layer consisting of a glod-based alloy. The contact layer has a thickness of at least 0.3 $\mu$m and consists of gold with a content of 0.5 percent by weight to 15 percent by weight of one or more platinum group metals, and that an intermediate layer consisting of silver of or a silver based alloy or of nickel is provided between the main body and the contact layer. The contact layer is preferably applied on the main body by a PVD process.

DETAILED DESCRIPTION OF THE INVENTION

Figure 1:
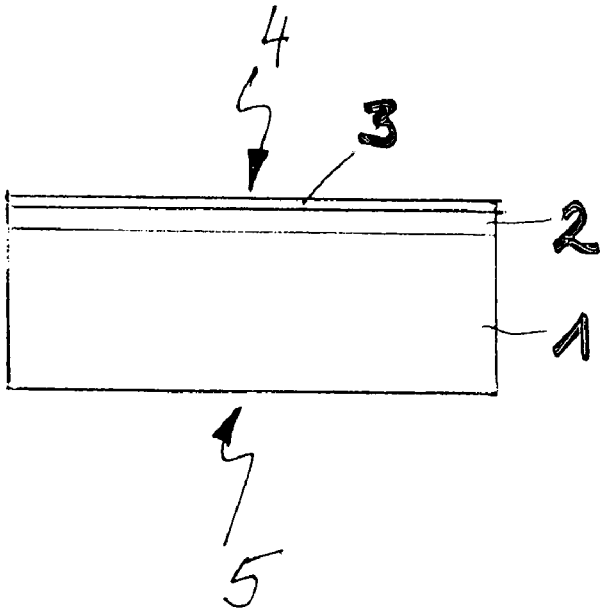
FIG. 1 shows a cross section through a semi-finished strip material for an electric plug-in contact

The electric contact according to the invention comprises a main body made from a copper-based alloy, a contact layer of gold with a minimum thickness of 0.3 $\mu$m and with a content of one or more platinum group metals of 0.5 percent by weight to 15 percent by weight, except for palladium which conveniently should be contained in the contact layer in percentages of up to 8 percent by weight only, if at all, and further an intermediate layer consisting of silver or a silver-based alloy, or of nickel, between the main body and the contact layer. The term "platinum group metals" is normally used to describe the jointly occurring metals of ruthenium, rhodium, palladium, osmium, iridium and platinum. The term "silver-based alloy" is meant to describe an alloy consisting predominantly of silver.

The contact layer guarantees a sufficiently low contact resistance and sufficient wear resistance, especially resistance to abrasion, and sufficient security from welding between contacting contacts. If an intermediate layer of silver or a silver-based alloy, for example silver with a few percent of an addition, such as nickel or palladium dissolved in the silver, for example a fine-grain silver like silver with 0.15 wt-% of nickel, is provided between the main body and the contact layer, the desired low contact resistance over 3000 hours at 200° Celsius is achieved even with a contact layer thickness of no more than 5 $\mu$m. Such an intermediate layer prevents any base components from diffusing from the main body into, and from oxidising on, the contact surface. Pure silver is particularly well suited as intermediate layer. Nickel as an intermediate layer is likewise suited to prevent any base components from diffusing from the main body to the contact surface, but is suitable for the present purpose only in cases where no particular ductility is required, because nickel is so brittle that cracks may form due to the small bending radii typically encountered when working plug-in contacts. In contrast, silver provides higher ductility and the alloy components contained in it, if any, should be of such kinds and be present in such quantities that the ductility required for the intended application on plug-in contacts, just as the efficiency of the diffusion barrier layer, will be preserved. Compared with this, silver provides the advantage that it can be applied at moderate cost in thicknesses of up to 10 $\mu$m. Preferably, the thickness of the intermediate layer is 0.2 μm to 10 μm, most preferably approximately 1 μm to 2 μm. This is sufficient to preserve the low contact resistance for a contact layer having a thickness of, preferably, only 0.5 μm to 2 μm, under the predetermined conditions of use and for the predetermined times of use. An intermediate layer of silver has proven its value especially in connection with such thin contact layers, on the one hand because it prevents any base components from diffusing from the main body into the contact layer and on the other hand because it is capable, in its capacity as sacrificial layer, to balance out any losses in the material of the contact layer.

Conveniently, the contact layer is not thicker than 10 μm. A contact layer thicker than 10 μm no longer provides any further technical improvement. Preferably, the contact layer is not thicker than 5 μm.

A platinum group metal suited for being alloyed to the gold is, above all, platinum itself. Palladium added in very small proportions, in any case in proportions of less than 8 percent by weight, is likewise well suited. Gold platinum and gold palladium alloys show very good oxidation stability and, in the composition set out in the claims, sufficient ductility for being worked without damage to the contact layer. Compared with palladium, platinum offers the advantage of being cheaper. Cost is an essential criterion that has to be observed especially in connection with mass-production parts for the automotive industry and telecommunication applications. Gold-platinum alloys distinguish themselves in addition by especially high corrosion stability and, compared with gold-palladium alloys, a lower tendency to form an organic cover layer by catalytic processes.

The contact layer should consist of gold containing one or more platinum group metals in proportions of 0.5 percent by weight to 15 percent by weight. If the content is less than 0.5 percent by weight, there exists an excessive tendency to cold-welding. Above 15 percent by weight, the contact layer will get too brittle and can then no longer be formed into plug-in contacts without a risk of breakage to the contact layer.

A contact layer consisting of gold with 1.5 percent by weight to 5 percent by weight of platinum, and having a thickness of 0.5 μm to 2 μm, especially one consisting of gold with 1 to 3 percent by weight of platinum and having a thickness of 0.5 μm to 2 μm, is especially preferred and, if applied above an intermediate layer of silver, is regarded as the optimum under aspects of cost, workability and stability under the given conditions of use.

In principle, the gold-based alloy for the contact layer may also contain other platinum group metals than platinum and palladium, especially in combination with platinum and palladium, for example ruthenium, although this does not provide any significant additional advantages. Finally, the gold-based alloy may contain silver in addition to a platinum group metal.

The intermediate layer preferably has a thickness of between 1 μm and 15 μm. Below 1 μm, the diffusion-preventing effect of the intermediate layer is so low that the thickness of the contact layer would have to be increased in this case to compensate for the low diffusion-preventing effect, which would be uneconomical. On the other hand, increasing the thickness of the intermediate layer above 15 μm is not required, technically, and is therefore uneconomical, too. An intermediate layer of silver having a thickness of approximately 1 μm to 2 μm is regarded as the optimum.

Electric plug-in contacts according to the invention usually are made from semi-finished strip materials, by punching, bending and embossing processes. The intermediate layer of silver or of a silver-based alloy, or of nickel, is applied onto strips of copper or of a copper-based alloy or of stainless steel having the desired spring properties, and then the contact layer consisting of the gold-based alloy is applied on top. The intermediate layer and the contact layer are preferably applied by sputtering. This is regarded as the most economical process for the intended small layer thicknesses, especially for the contact layer, and in addition leads to sufficiently dense and ductile layers, without any foreign-matter inclusion. The intermediate layer and the contact layer may even be applied in succession in a single coating process. Electrolytic deposition is, however, likewise a method of choice, especially for the intermediate layer.

Preferably, the material from which the intermediate layer is made up, is applied not only on that front of the main body on which the contact layer will be applied as well, but also on the rear surface of the main body. Especially at the high temperature at which contacts according to the invention are to be used, this results in the additional advantage that the contact resistance will rise to a lesser extent over time than without such a coating on the rear surface of the main body.

This is illustrated by the following example: A strip-like main body consisting of copper was coated on one side with a silver layer of 2 μm and then with an AuPt2.5 layer of 1 μm thickness. The contact resistance measured was initially 2 mÙ. After ageing for 300 hours in air at 200° Celsius the contact resistance rose to values of between 1 Ù and 10 Ù. When the rear surface of the copper strip was likewise coated with a silver layer of 2 μm thickness, the contact resistance rose only by a few mÙ under the same ageing conditions. The lateral surfaces of the main body, which was formed by punching, were free from silver when this good result was achieved. This leads to the additional advantage that it is possible without any disadvantage for the contact resistance to coat strip-shaped or plate-shaped main bodies in a first step and to separate them thereafter by punching.

The following materials are especially well suited for the main body:

(a) CuNiSi(Mg): The materials designated C7025, C7026 according to ASTM
(b) CuFeP: The material designated C 194 according to ASTM
(c) CuCrSiTi(X): The materials designated C18070, C18080, C18090 according to ASTM
(d) CuNiSn: The material designated C72500 according to ASTM
(e) CuSnZn: The material designated C 425 according to ASTM
(f) CuNiZn: The materials designated C75700, C77000 C76400 according to ASTM
(g) Stainless steel: The materials designated
1.4310 according to DIN 7224,
1.4311 according to DIN 7440,
1.4406 according to DIN 7440,
1.4428 according to DIN 7443,
1.4429 according to DIN 7440,
1.4568 according to DIN 7224,
1.4841 according to DIN 7224,
1.4318, 1.1232, 1.1248, 1.1269, 1.1274, 1.5029 according to DIN V 17006-100, the materials mentioned under (a), (b) and (c) above being particularly preferred because they unite in themselves high electric conductivity and high stability of their spring characteristics under the demanded temperature of use of 200° Celsius.

The invention is suited not only for plug-in contacts but also for switching contacts.

Figure 2:
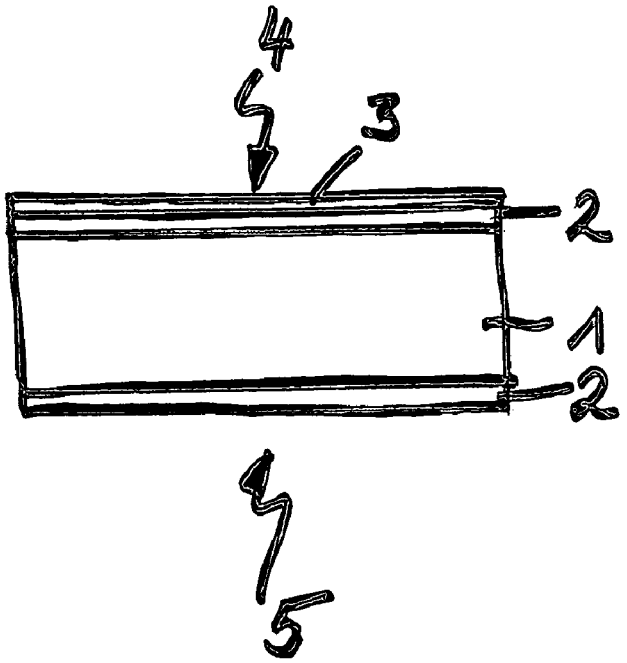
FIG. 2 shows a cross section through a semi-finished strip material for an alternative electric plug-in contact.

FIG. 1 shows a cross-section through a semi-finished strip materials for an electric plug-in contact according to the invention, comprising a main body 1 consisting of a copper-based alloy, such as CuCrSiTi(X), an intermediate layer 2, consisting of silver with a thickness of between 0.2 μm to 15 μm, and a contact layer 3, having a thickness of 0.5 μm to 2 μm and consisting of gold with 1 percent by weight to 5 percent by weight of platinum. The intermediate layer 2 is found only on the front of the main body. As shown in FIG. 2, the material, from which is made the intermediate layer 2, or another material suited as diffusion barrier, may be applied with advantage also to the rear surface 5.

What is claimed is:

1. Electric contact comprising a main body consisting of a cooper-based alloy or of stainless steel and a contact layer consisting of a gold-based alloy, characterized in that the contact layer has a thickness of at least 0.3 μm and consists of gold with a content of 0.5 percent by weight to 15 percent by weight of one or more platinum groups metals and that an intermediate layer consisting of silver or of a silver-based alloy or of nickel is provided between the main body and the contact layer, characterized in that the contact layer is not thicker than 10 μm.

2. The electric contact as defined in claim 1, characterized in that the contact layer is not thicker than 5 μm.

3. The electric contact as defined in claim 1, characterized in that the contact layer has a thickness of 0.5 μm to 2 μm.

4. The electric contact as defined in claim 1, characterized in that the contact layer has a thickness of 0.5 μm to 1 μm.

5. The electric contact as defined in claim 1, characterized in that platinum or palladium is selected as the platinum group metal.

6. The electric contact as defined in claim 5, characterized in that the contact layer contains platinum as the platinum group metal.

7. The electric contact as defined in claim 1, characterized in that the contact layer consists of gold with a content of 1 percent by weight to 5 percent by weight of one or more platinum group metals.

8. The electric contact as defined in claim 7, characterized in that the contact layer contains platinum only as the platinum group metal.

9. The electric contact as defined in claim 1, characterized in that the contact layer consists of gold with a content of 1 percent by weight to 3 percent by weight of one or more platinum group.

10. The electric contact as defined in claim 9, characterized in that the contact layer contains platinum only as the platinum group metal.

11. The electric contact as defined in claim 1, characterized in that the intermediate later has a thickness of 0.2 μm to 15 μm.

12. The electric contact as defined in claim 1, characterized in that the intermediate layer has a thickness of 0.5 μm to 10 μm.

13. The electric contact as defined in claim 1, characterized in that a material from the following group is selected as material for the main body:

(a) CuNiSi(Mg): The materials designated C7025, C7026 according to ASTM;

(b) CuFeP;

(c) CuCrSiTi(X);

(d) CuNiSn;

(e) CuSnZn;

(f) CuNiZn; and (g) Stainless steel.

14. The electric contact as defined in claim 1, characterized in that the contact layer is formed by sputtering or by another process.

15. Electric contact comprising a main body consisting of a copper-based alloy or of stainless steel and a contact layer consisting of a gold-based alloy, characterized in that the contact layer has a thickness of at least 0.3 μm and consists of gold with a content of 0.5 percent by weight to 15 percent by weight of one or more platinum groups metals and that an intermediate layer consisting of silver or of a silver-based alloy or of nickel is provided between the main body and the contact layer, characterized in that the main body has a front side and a rear side, that the contact layer is arranged on the front side, and that the material, from which the intermediate layer is made up, is present on both the front side and the rear side of the main body.

16. The electric contact as defined in claim 15, characterized in that in the case of main bodies having a thickness, a length and a width, said width of the main bodies is small as compared with their length and width, lateral surfaces of the main body between the front and rear sides are free from the material from which the intermediate layer is made up.

17. The electric contact as defined in claim 1, characterized in that a palladium content in the gold does not exceed 8 percent by weight.

18. The electric contact as defined in claim 1, characterized in that the contact layer is formed by sputtering.

19. Electric contact comprising a main body consisting of a copper-based alloy or of stainless steel and a contact layer consisting of a gold-based alloy, characterized in that the contact layer has a thickness of at least 0.3 μm and consists of gold with a content of 0.5 percent by weight to 15 percent by weight of one or more platinum groups metals and that an intermediate layer consisting of silver or of a silver-based alloy or of nickel is provided between the main body and the contact layer, characterized in that the intermediate layer has a thickness of 1 μm to 2 μm.

* * * * *